US005097612A

United States Patent [19]

Williams

[11] Patent Number: 5,097,612

[45] Date of Patent: Mar. 24, 1992

[54] ILLUMINATED TRAFFIC CONTROL SIGN

[75] Inventor: Clyde A. Williams, Irwin, Pa.

[73] Assignee: Syntonic Technology, Inc., Harrisburg, Pa.

[21] Appl. No.: 588,571

[22] Filed: Sep. 26, 1990

[51] Int. Cl.[5] ..... G09F 21/04

[52] U.S. Cl. ..... 40/591; 40/487; 40/550; 116/28 R; 340/473

[58] Field of Search ..... 40/591, 610, 492, 612, 40/487, 450, 451, 550, 452, 486; 116/28 R, 35 R, 42, 45; 340/473, 475

[56] References Cited

U.S. PATENT DOCUMENTS

| | | | |
|---|---|---|---|
| 1,315,185 | 9/1919 | Hart | 116/45 |
| 1,325,831 | 12/1919 | Carr et al. | 40/550 |
| 2,671,423 | 3/1954 | Mead . | |
| 3,197,904 | 8/1965 | Holcomb | 40/452 |
| 3,430,374 | 3/1969 | Woodward . | |
| 3,590,506 | 7/1971 | Jeski . | |
| 3,594,938 | 7/1971 | Mosch . | |
| 3,622,980 | 11/1971 | Elledge, Jr. | 40/591 X |
| 3,903,629 | 9/1975 | Gruna . | |
| 3,949,503 | 4/1976 | Waress | 40/591 |
| 4,062,139 | 12/1977 | Klosel . | |
| 4,192,090 | 3/1980 | Seth . | |
| 4,539,768 | 9/1985 | Halliday | 40/450 X |
| 4,592,158 | 6/1986 | Seely | 40/612 X |
| 4,607,444 | 8/1986 | Foster . | |
| 4,729,184 | 3/1988 | Cihanek | 40/450 |
| 4,999,938 | 3/1991 | Behling | 40/610 |

FOREIGN PATENT DOCUMENTS

| | | | |
|---|---|---|---|
| 384736 | 4/1908 | France | 116/42 |
| 254710 | 4/1930 | Italy | 116/42 |

*Primary Examiner*—Kenneth J. Dorner
*Assistant Examiner*—Brian K. Green
*Attorney, Agent, or Firm*—Buchanan Ingersoll

[57] ABSTRACT

An illuminated traffic control sign transforms a conventional passenger automobile into a traffic control vehicle. The body of the sign is formed from a flexible sheet of weather resistant material. The sign is ordinarily stored under the luggage compartment lid of the automobile when not in use and is deployed between the open lid and the lower part of the luggage compartment when in use. The flexible sheet has a horizontal double arrow design formed on it in a color that contrasts with the color of the sheet. Electric light fixtures are attached over the double arrow design to illuminate the design when the fixtures are activated. A plurality of flaps are secured to the flexible sheet and may be moved between retracted positions where they reveal the double arrow design or active positions where they cover part of the design. By positioning the flaps, the double arrow design may be selectively changed to a right arrow, a left arrow, or a caution bar without an arrowhead. The electrical circuit that activates the light fixtures may be connected to the automobile electrical system or it may be independent of it.

18 Claims, 2 Drawing Sheets

ILLUMINATED TRAFFIC CONTROL SIGN

BACKGROUND OF THE INVENTION

1. Field of the Invention

This invention relates to an illuminated traffic control sign for transforming a conventional passenger automobile into a traffic control vehicle. The sign may be stowed in the luggage compartment of a conventional passenger automobile when not in use and then displayed and illuminated from the luggage compartment of the vehicle when it is time to use the sign.

2. Description of the Prior Art

Large vehicle mounted traffic control signs are well known to those who travel the highways. These signs are usually mounted on top of a pick-up truck, on a trailer, or other similar vehicle, are rigid, and have a double arrow directional signal which flashes to warn motorists when there is danger ahead and indicates to the motorist the direction that he should proceed to avoid the danger. The signs are illuminated with flashing lights and are visible at great distances.

It is also well known to have caution signs which may be stowed in the luggage compartment of a vehicle and displayed when the individual vehicle has difficulties, such as a flat tire or an engine malfunction, which disable the vehicle on the roadway. Examples of such signs which are normally carried in an automobile luggage compartment and may be displayed therefrom are shown in U.S. Pat. No. 2,671,423, U.S. Pat. No. 3,430,374, U.S. Pat. No. 3,590,506, and U.S. Pat. No. 3,594,938.

Vehicle mounted signs which may be illuminated have also been disclosed in U.S. Pat. No. 4,192,090 and U.S. Pat. No. 4,607,444. Signs on which the message can be changed by utilizing additional elements that hinge or overlay the sign are shown in U.S. Pat. No. 3,903,629 and U.S. Pat. No. 4,062,139.

While the prior art shows various types of vehicle mounted signs, none of these signs enable a standard conventional passenger automobile to be converted into a traffic control vehicle that displays a double arrow illuminated sign such as are mounted on trucks or other vehicles. There is a need for an illuminated traffic control sign which may be stored inobtrusively in the luggage compartment of a vehicle, but which may be converted to an illuminated double arrow traffic sign so that police cars, or other conventional passenger automobiles that patrol the nation's highways may be utilized, in an emergency, for traffic control without radically modifying those vehicles when they are not in emergency service.

SUMMARY OF THE INVENTION

In accordance with the present invention there is provided an illuminated traffic control sign for transforming a conventional passenger automobile into a traffic control vehicle. The traffic control sign comprises a flexible sheet of weather resistant material secured to the luggage compartment of the passenger vehicle so that the sheet hangs substantially vertically from the luggage compartment lid when the lid is open and the sign is in use. The flexible sheet has a horizontal double arrow design formed on it in a color contrasting with the color of the sheet. A plurality of electrical light fixtures are mounted on the flexible sheet on top of the double arrow design to illuminate the design when the fixtures are activated. A plurality of flaps are secured to the flexible sheet to selectively cover or uncover parts of the double arrow design so that the design may be optionally transformed into a single arrow pointing in either direction or into a caution bar not having an arrowhead. An electrical circuit is provided to selectively activate the electrical light fixtures.

Further in accordance with the present invention, there is provided in illuminated traffic control sign for transforming a conventional passenger automobile into a traffic control vehicle. The sign comprises a flexible sheet of weather resistant material that has a front surface and a back surface and is secured to the luggage compartment lid of the passenger vehicle and is folded and secured to the interior surface of the lid when not in use. The flexible sheet is disposed between the lid and the lowermost opening of the luggage compartment when the lid is open and the sign is in use. The flexible sheet has a horizontal double arrow design formed on it in a color contrasting with the color of the sheet. A stiffener is secured to the flexible sheet back surface behind the double arrow design. A plurality of electrical light fixtures are mounted on the flexible sheet on top of the double arrow design and are at least partially supported by the stiffener to illuminate the design when the fixtures are activated. A plurality of flexible flaps formed from the same material as the flexible sheet are secured to the flexible sheet to selectively cover or uncover parts of the double arrow design so that the design may be optionally transformed into a single arrow pointing in either direction or into a caution bar not having an arrowhead. Snap fasteners are secured to each of the flaps and to the flexible sheet to secure each of the flaps in one of two positions relative to the flexible sheet. An electrical circuit is provided to selectively activate the electrical light fixtures. The circuit includes an arrangement to intermittently flash the electrical light fixtures and to selectively operate only those light fixtures that are exposed and not covered by the flaps.

Accordingly, the principal object of the present invention is to provide an illuminated traffic control sign that can be stored in the luggage compartment of a conventional passenger automobile and can then be used to provide traffic control under emergency conditions.

Another object of the present invention is to provide an illuminated double arrow traffic control sign that approximates the sign that is usually mounted on a truck or trailer, but which can be carried in a conventional passenger automobile and utilized as necessary in emergency conditions.

A further object of the present invention is to provide a traffic control sign which can be carried in police cars or in turnpike maintenance cars so that those cars can be converted to emergency vehicles quickly and without any special tools or adapters.

These and other objects of the present invention will be more completely disclosed and described in the following specification, the accompanying drawings, and the appended claims.

DESCRIPTION OF PREFERRED EMBODIMENT

Figure 1:
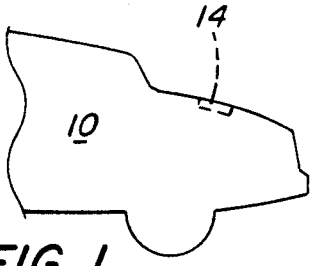
FIG. 1 is a schematic representation of a passenger automobile with the sign of the present invention stored in the luggage compartment.
Figure 2:
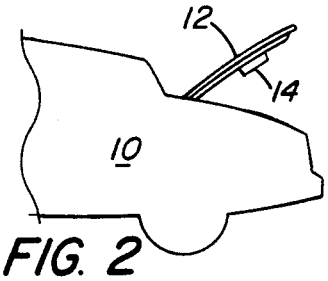
FIG. 2 is a schematic representation similar to FIG. 1 showing the luggage compartment lid open and the sign of the present invention stowed under the luggage compartment lid.
Figure 3:
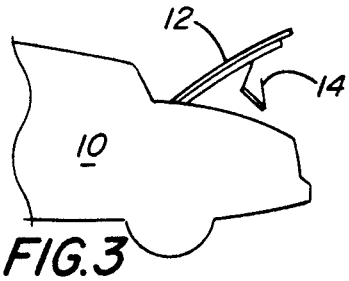
FIG. 3 is a representation similar to FIGS. 1 and 2 showing the sign in a partially displayed condition.
Figure 4:
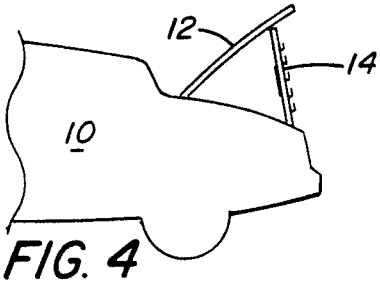
FIG. 4 is a representation similar to FIGS. 1, 2 and 3 showing the sign of the present invention in a fully displayed position.

Referring to the drawings, and particularly to FIGS. 1–4, there is schematically shown a conventional passenger automobile 10 with a luggage compartment lid 12 that is in the raised position in FIGS. 2–4. The traffic control sign 14 of the present invention is shown in a stored position within the luggage compartment of the vehicle 10 in FIG. 1. The sign is preferably stored under the luggage compartment lid 12 as is best seen in FIG. 2. In FIG. 3, the sign is partially released and in FIG. 4, the sign 14 is in the fully operable position to be viewed from behind the vehicle 10 by oncoming motorists.

Figure 5:
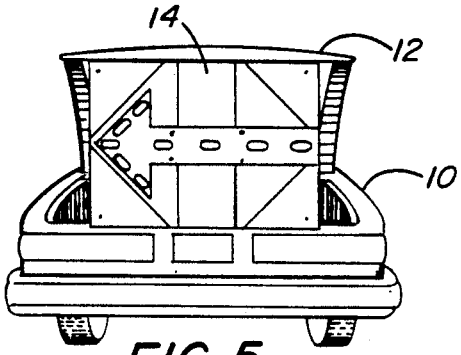
FIG. 5 is a rear view of a conventional passenger automobile showing the sign of the present invention displayed in the luggage compartment.

FIG. 5 shows the rear view of the conventional passenger vehicle 10 with the luggage compartment lid 12 raised and the traffic control sign 14 disposed in a generally vertical manner to be observed from behind the vehicle 10.

Figure 6:
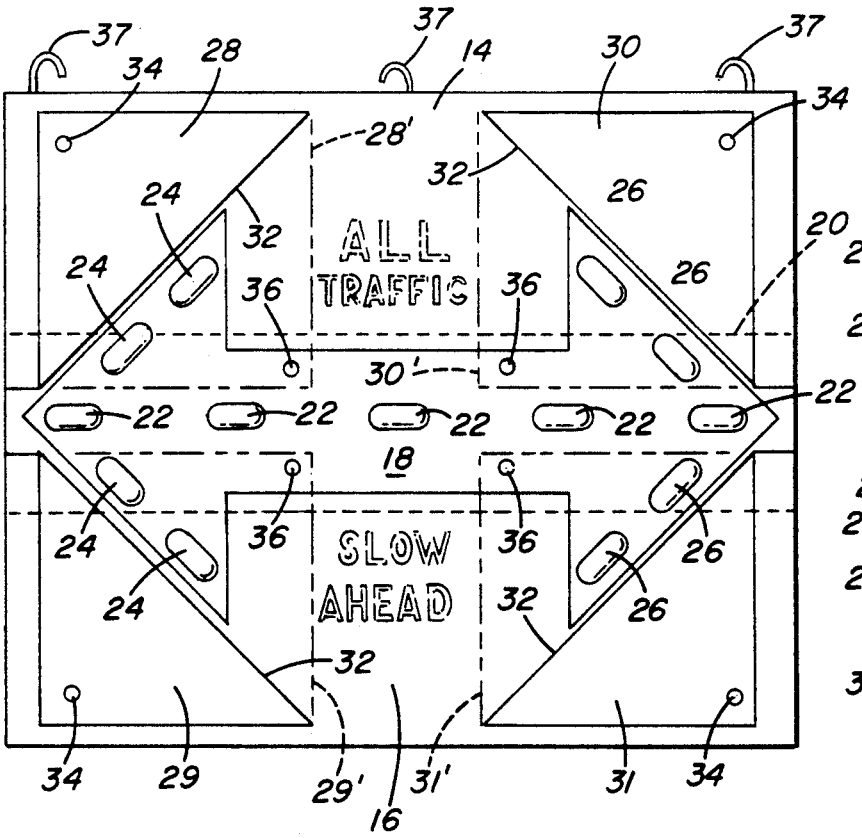
FIG. 6 is a plan view of the sign of the present invention showing certain details of construction of the sign.
Figure 7:
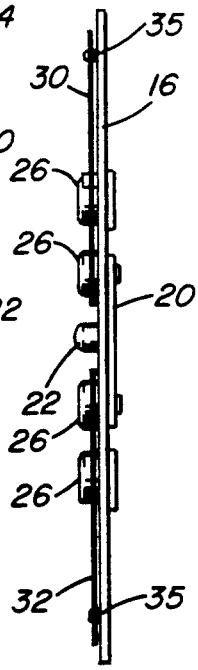
FIG. 7 is an end view of the sign of FIG. 6.

Referring to FIGS. 6 and 7, details of the construction of the traffic control sign are shown. The sign 14 is formed from a flexible sheet 16 that has a horizontal double arrow design 18 formed on the front surface of the sheet. The flexible sheet 16 is formed of weather resistant material such as rubberized canvas or plastic.

A stiffener 20 is fixed to the rear surface of sheet 16 behind the double arrow design 18 to assist in supporting electrical light fixtures as will be described. The stiffener 20 is preferably formed from a semi-rigid plastic material or a thin sheet of aluminum. Stiffener 20 may be riveted to the flexible sheet 16 by rivets (not shown).

A series of electrical lights 22 are positioned horizontally on top of the double arrow design 18 and serve to illuminate the crossbar of the double arrow design when illuminated. Similar electrical lights 24 are positioned over the left arrow of the horizontal double arrow design 18 and similar lights 26 are positioned over the right arrow of the design 18. Electrical lights 22, 24 and 26 are of identical construction and are preferably provided with amber colored lenses over the light bulbs. The lights 22, 24 and 26 are secured to the flexible sheet 16 and to the stiffener 20 by rivets or the like (not shown) that pass through the flexible sheet 16 and, where applicable, the stiffener 20.

As best seen in FIG. 6, the flexible sheet 16 has a flap 28 which is secured to the sheet generally in the upper left-hand corner of the sheet 16. A similar flap 29 is secured in the lower left-hand corner, a flap 30 is secured in the upper right-hand corner, and a flap 31 is secured in the lower right-hand corner of flexible sheet 16 as viewed in FIG. 6. Each of the flaps 28, 29, 30 and 31 are preferably formed of the same material from which the flexible sheet 16 is formed and each of the flaps is generally triangular in shape and secured at a seam 32 to the flexible sheet 16. The respective seams 32 are generally parallel to an edge of one of the arrowheads on the double arrow design 18.

As shown in FIG. 6, each of the flaps 28, 29, 30 and 31 is in a retracted position so that it is folded away from the double arrow design 18 on sheet 16. Snap fasteners 34 are secured to the corner of each of the flaps 28, 29, 30 and 31 and cooperate with snap fasteners 35 (FIG. 7) to hold the flaps in the retracted position. It should be understood that other types of fasteners such as VELCRO strips may be utilized instead of snap fasteners 34 and 35.

Each of the flaps 28, 29, 30 and 31 can selectively be moved from the retracted position shown in full lines on FIG. 6 to an active position. The active position for flap 28 is shown in broken lines at 28 prime, the active position for flap 29 is shown at 29 prime, the active position for flap 30 is shown at 30 prime, and the active position for flap 31 is shown at 31 prime. When in the active position, snap fastener 34 on each of the flaps cooperates with a snap fastener 36 fixed to the front surface of flexible sheet 16. The flexible sheet 16 has hooks 37 fixed to it and the hooks 37 cooperate with holes in the underside of the luggage compartment lid 12 to attach the sign 14 to the luggage compartment lid.

When the sign 14 is stored under the luggage compartment lid 12 as shown in FIGS. 1 and 2, the flexible sheet 16 is folded and one or more elastic bands having hooks on the end (not shown) are placed across the sign 14 and hooked into corresponding holes in the underside of the luggage compartment lid. Snap fasteners (not shown) may also be secured to the bottom edge of flexible sheet 16 to mate with corresponding snap fasteners on the interior of the luggage compartment of the vehicle 10 to secure the bottom edge of the flexible sheet 16 within the luggage compartment. It should be understood that the specific method of mounting the flexible sheet 16 within the luggage compartment of the vehicle 10 can take several different forms, each of which falls within the scope of this invention.

Referring now to FIGS. 8–11, the various positions of the flaps 28, 29, 30 and 31 are shown to form specific patterns from the double arrow design 18 formed on sheet 16. For clarity, the electrical lights 22, 24 and 26 have not been shown on FIGS. 8 through 11, although it should be understood that the electrical lights will be present.

Figure 8:
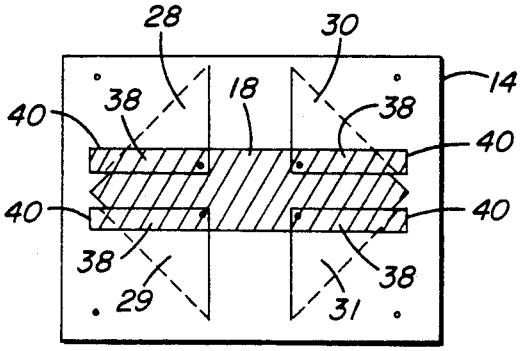
FIG. 8 shows the sign of the present invention in a caution bar mode.

As shown in FIG. 8, all four flaps 28, 29, 30 and 31 have been moved from the retracted position shown in FIG. 6 to the active position so that they cover the arrowheads on double arrow design 18 and leave only a horizontal caution bar. With the flaps in the position shown in FIG. 8, lights 24 and 26 are covered by the flaps. It should be noted that the reverse side of the flaps have increments 38 of the horizontal double arrow design formed on the flaps to complete a solid bar as shown in FIG. 8. Further, increments 40 of the solid bar design are formed on the flexible sheet 16 and are covered by flaps 28, 29, 30 and 31 when the flaps are in the retracted position shown in FIG. 6.

Figure 9:
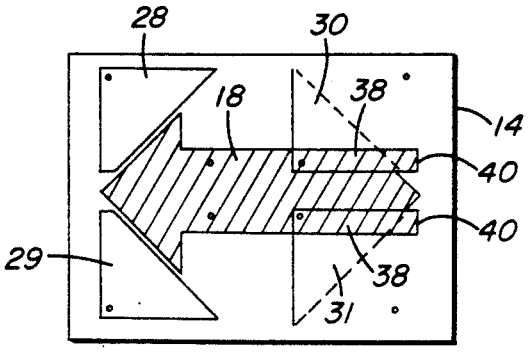
FIG. 9 shows the sign of the present invention in a left arrow mode.

FIG. 9 shows the sign 14 with flaps 28 and 29 retracted and flaps 30 and 31 in the active position so that a left arrow is produced by the cooperation of the double arrow design 18 and the flap position. In this case, the electrical lights 26 (FIG. 6) are covered, whereas the electrical lights 24 on the left arrow are exposed.

Figure 10:
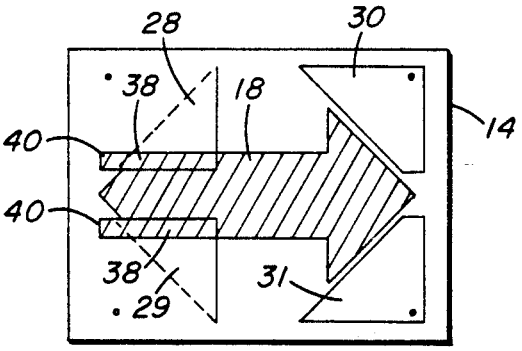
FIG. 10 the sign of the present invention in a right arrow mode.

In FIG. 10, flaps 28 and 29 are in the active position covering the left arrow and flaps 30 and 31 are in the retracted position so that a right arrow is exposed to the viewer. In similar fashion, flaps 28 and 29 cover lights 24 that form the left arrow.

Figure 11:
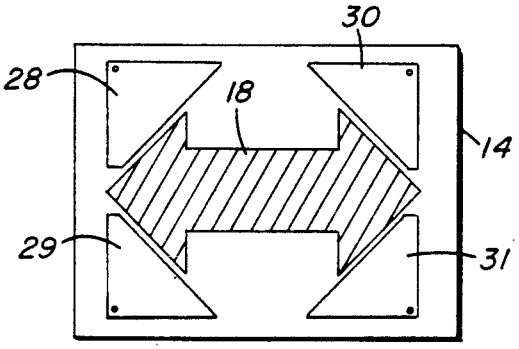
FIG. 11 shows the sign of the present invention in a double arrow mode.

FIG. 11 shows all flaps 28, 29, 30 and 31 in the retracted position and corresponds to a position shown in FIG. 6. In this instance, a double arrow design is exposed and all of the lights 22, 24 and 26 are exposed.

Figure 12:
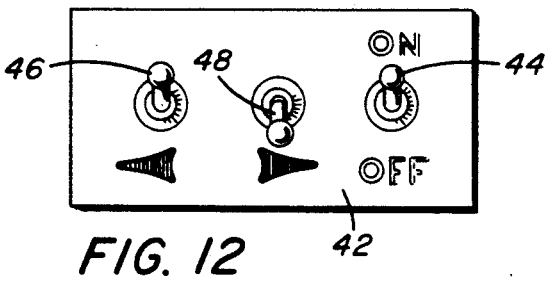
FIG. 12 shows the control switches for the electrical circuit of the present invention.

FIG. 12 shows a switch panel or the electrical circuit (not shown) of the present invention. The electrical circuit is conventional and may be either connected to the electrical system of the passenger vehicle 10 or may be operated from a separate source of supply such as a battery that is carried in the luggage compartment of the vehicle. The electrical circuit contains a conventional flashing device. The flashing device causes the lights to flash when they are activated in order to attract the attention of on-coming motorists that view the sign.

When the caution bar switch 44 of FIG. 12 is placed in the "on" position, lights 22 on the caution bar of the double arrow design 18 are activated. When left arrow switch 46 is placed in the "on" position, the lights 24 on the left arrow are activated, and when the right arrow switch 48 is placed in the "on" position the lights 26 on the right arrow are activated.

In operation, the sign 14 of the present invention is carried within the luggage compartment of, for example, a police car that patrols the highway. If the police are called to the scene of an accident, or a rock slide on the road, or other road hazards, the passenger vehicle 10 may be positioned strategically so that the sign 14 may be deployed and be visible to on-coming traffic. The lid of the luggage compartment is then raised and the sign is released and unfolded as shown in FIGS. 1 through 4. The traffic officer then selects the pattern which will best direct the flow of traffic around the road hazard.

If, for example, traffic moving to the left around the vehicle will provide the safest pattern, flaps 28 and 29 will be retracted and snapped into position. Flaps 30 and 31 will be activated and snapped into position on snaps 36. The caution bar switch 44 will be turned to the "on" position to activate lights 22 and the left arrow switch 46 will be turned to the "on" position to activate lights 24. The right arrow switch 48 will be turned to the off position since lights 26 will be covered by flaps 30 and 31 respectively. It is to be understood that, in some cases, it may be desirable to utilize the double arrow pattern if traffic may move safely in either direction around a hazard.

It will be seen that in a very short time after arriving on the scene of a road hazard, a vehicle equipped with the sign of the present invention may be positioned and the sign deployed to provide safe passage for on-coming vehicles.

According to the provisions of the Patent Statutes, I have explained the principle, preferred construction, and mode of operation of my invention and have illustrated and described what I now consider to represent its best embodiment. However, it should be understood that, within the scope of the appended claims, the invention may be practiced otherwise than as specifically illustrated and described.

I claim:

1. In combination, an illuminated traffic control sign and a conventional passenger automobile having a rear luggage compartment with a lid for closing said luggage compartment whereby said sign when displayed transforms said automobile into a traffic control vehicle comprising:

a flexible sheet of weather resistant material secured to said luggage compartment lid of said passenger vehicle so that said sheet hangs substantially vertically from said lid when said lid is open and said sign is in use and is stored within said luggage compartment when not in use, said flexible sheet having a horizontal double arrow design with two arrowheads thereon in a color contrasting with said sheet;

a plurality of electrical light fixtures mounted on said flexible sheet on top of said double arrow design to illuminate said design when said fixtures are activated;

a plurality of flaps secured to said flexible sheet to selectively cover or uncover parts of said double arrow design so that said design may be optionally transformed into a single arrow pointing in either direction or into a caution bar not having an arrowhead, each of said flaps being generally triangular in shape and secured at a seam to said flexible sheet, each respective seam being generally parallel to an edge of one of the arrowheads on the double arrow design; and electrical circuit means to selectively activate said electrical light fixtures.

2. The traffic control sign of claim 1 wherein said sign is folded and secured to the interior surface of said luggage compartment lid when not in use.

3. The traffic control sign of claim 1 wherein said flexible sheet is formed of rubberized canvas.

4. The traffic control sign of claim 1 wherein said flexible sheet is formed of plastic.

5. The traffic control sign of claim 1 wherein said horizontal double arrow design is painted onto said flexible sheet.

6. The traffic control sign of claim 1 wherein the back side of said flexible sheet has a stiffener secured thereto to help support said electrical light fixtures.

7. The traffic control sign of claim 1 wherein each of said flaps is secured by snap fasteners in either one of two positions.

8. The traffic control sign of claim 1 wherein said flaps are formed from the same material as said flexible sheet.

9. The traffic control sign of claim 1 wherein said electrical circuit means is connected to the electrical system of said automobile.

10. The traffic control sign of claim 1 wherein said electrical circuit means is independent of the electrical system of said automobile.

11. The traffic control sign of claim 1 wherein said electrical circuit means contains means to intermittently flash said electrical light fixtures.

12. The traffic control sign of claim 1 wherein said electrical circuit may be operated to selectively activate only those light fixtures that are exposed and not covered by said flaps.

13. In combination, an illuminated traffic control sign and a conventional passenger automobile having a rear luggage compartment with a lid for closing said luggage compartment whereby said sign when displayed transforms said automobile into a traffic control vehicle comprising:

a flexible sheet of weather resistant material having a front surface and a back surface secured to the interior surface of said luggage compartment lid of said passenger vehicle and being folded and secured against said luggage compartment lid when not in use, said flexible sheet being disposed between said luggage compartment lid and the lowermost opening of said luggage compartment when said lid is open and said sign is in use;

a horizontal double arrow design having two arrowheads formed on said flexible sheet front surface in a color contrasting with said front surface;

stiffening means secured to said flexible sheet back surface behind said double arrow design;

a plurality of electrical light fixtures mounted on said flexible sheet on top of said double arrow design and at least partially supported by said stiffening means to illuminate said design when said fixtures are activated;

a plurality of flexible flaps secured to said flexible sheet to selectively cover or uncover parts of said double arrow design so that said design may be optionally transformed into a single arrow pointing in either direction or onto a caution bar not having an arrowhead, each of said flaps being generally triangular in shape and secured at a seam to said flexible sheet, each respective seam being generally parallel to an edge of one of the arrowheads on the double arrow design;

electrical circuit means to selectively activate said electrical light fixtures, said electrical light circuit means containing means to intermittently flash said electrical light fixtures.

14. The traffic control sign of claim 13 wherein said flexible sheet is formed of rubberized canvas.

15. The traffic control sign of claim 13 wherein said flexible sheet is formed of plastic.

16. The traffic control sign of claim 13 wherein each of said flaps is secured by snap fasteners in either one of two positions.

17. The traffic control sign of claim 13 wherein said flaps are formed from the same material as said flexible sheet.

18. In combination, an illuminated traffic control sign and a vehicle having a front and rear comprising:

a flexible sheet of weather resistant material having a front surface and a back surface that may be compactly stored within said vehicle when not in use, said flexible sheet having a horizontal double arrow design with two arrowheads on said sheet front surface in a color contrasting with said sheet;

securing means to secure said flexible sheet in a substantially vertical position on said rear of said vehicle so that said sheet front surface may be viewed from behind said vehicle;

stiffening means secured to said flexible sheet back surface behind said double arrow design;

a plurality of electrical light fixtures mounted on said flexible sheet front surface on top of said double arrow design and at least partially supported by said stiffening means to illuminate said design when said fixtures are activated;

a plurality of flexible flaps formed from the same material as said flexible sheet secured to said flexible sheet to selectively cover or uncover parts of said double arrow design so that said design may be optionally transformed into a single arrow pointing in either direction or into a caution bar not having an arrowhead, each of said flaps being generally triangular in shape and secured at a seam to said flexible sheet, each respective seam being generally parallel to an edge of one of the arrowheads on the double arrow design;

snap fastener means secured to said flaps and to said flexible sheet to secure each of said flaps in one of two positions relative to said flexible sheet; and electrical circuit means to selectively activate said electrical light fixtures, said circuit means containing means to intermittently flash said electrical light fixtures and to selectively operate only those light fixtures that are exposed and not covered by said flaps.

* * * * *